United States Patent [19]

Rookmaaker

[11] Patent Number: 4,826,161

[45] Date of Patent: May 2, 1989

[54] BALLOON GAME

[75] Inventor: Frans V. Rookmaaker, Breda, Netherlands

[73] Assignee: Tom Franklin Fikkert, Netherlands

[21] Appl. No.: 80,000

[22] Filed: Jul. 31, 1987

[51] Int. Cl.[4] ..... A63F 9/00

[52] U.S. Cl. ..... 273/1 GF

[58] Field of Search ..... 273/1 R, 1 F, 1 GF, 273/420

[56] References Cited

U.S. PATENT DOCUMENTS

| | | | |
|---|---|---|---|
| 3,460,830 | 8/1969 | Barlow et al. | 273/1 F |
| 3,608,903 | 9/1971 | Cooper et al. | 273/1 R X |
| 3,685,825 | 8/1972 | Dorazio | 273/1 R |
| 3,795,400 | 3/1974 | Glass et al. | 273/1 R |
| 3,870,298 | 3/1975 | Varga | 273/1 GF |
| 4,086,901 | 5/1978 | Clement | 273/428 X |
| 4,169,593 | 10/1979 | Wood | 273/1 GF |

FOREIGN PATENT DOCUMENTS

| | | | |
|---|---|---|---|
| 6802712 | 8/1969 | Netherlands | 273/420 |

*Primary Examiner*—Paul E. Shapiro

*Attorney, Agent, or Firm*—John P. Snyder

[57] ABSTRACT

A game including a single rupturable inflated balloon confined in fixed position in a cylindrical envelope with the balloon protruding through the opposite ends of the envelope. The envelope has apertures therein aligned with the balloon. A plurality of game members of different lengths can be inserted through the apertures to partially penetrate the interior of the envelope and engage the balloon, and the members may be locked in position. The envelope may be translucent. The game members deform and ultimately rupture the balloon.

15 Claims, 1 Drawing Sheet

BALLOON GAME

The present invention relates to an envelope for an inflatable element, the envelope comprising apertures for inserting substantially pinshaped game elements.

Such an envelope which is used for playing a game is known from the U.S. Pat. No. 3.608.903.

This known envelope takes the shape of a box, which is made of opaque material and wherein the top of said box comprises apertures in which nails can be driven. The box is partially filled with a number of inflated balloons. During the game, which can be played with this box, the game players drive nails through the apertures in the top of the box. The one hitting a balloon and making it burst during the driving in of the nail is the loser. When driving the nails into the box, it is thus important to "miss" the balloons.

When a small number of nails has been driven into the box the ballon will have been fixed, thus making the next nail to be driven in almost surely a "hit". Thus the ballon will burst already with a small number of applied nails so that each game has only a short duration.

The aim of the present invention is to provide an envelope, through which a greater number of game elements can be driven before the inflatable element bursts so that the duration of the game which can be played with the envelope and the inflatable element is substantial.

This aim is reached in that the envelope comprises means for clamping the inflatable element and in that the game elements have limited lengths.

Figure 1:
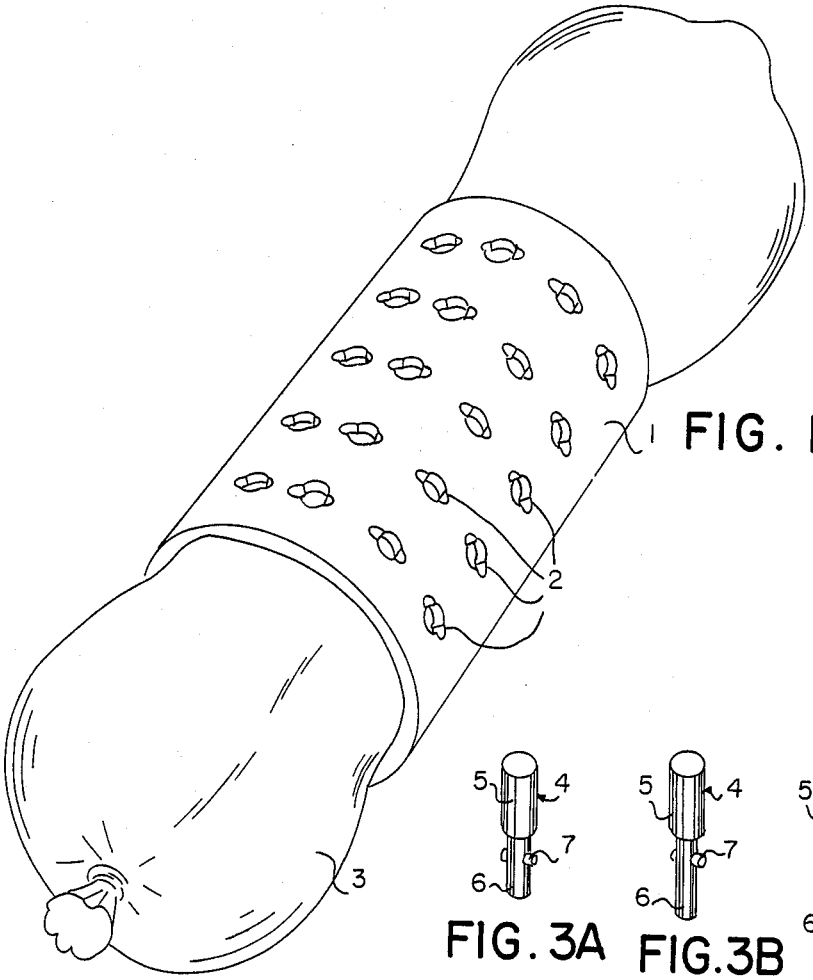
Figures 3A, 3B, 3C:
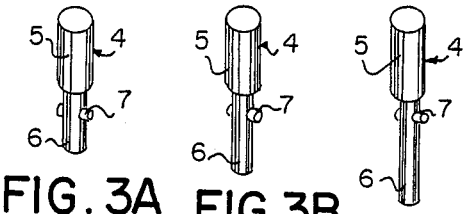
Figure 2:
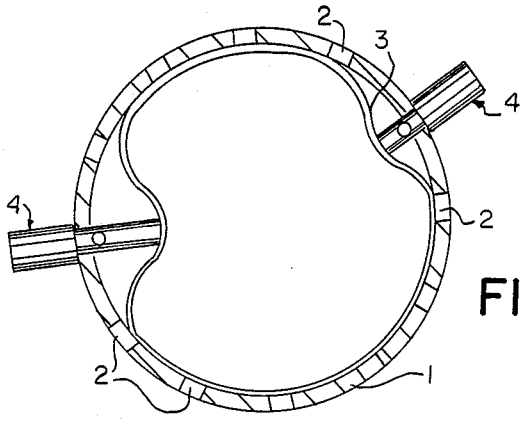

Hereafter the present invention will be illucidated referring to the accompanying drawings, in which:

FIG. 1: is a perspective view of an envelope according to the present invention, in which an inflatable element has been provided;

FIG. 2: is a schematic cross-sectional view of the combination of an inflatable element and an envelope, which has been depicted in FIG. 2, in which a number of game elements has been driven into the apertures provided in the envelope; and FIGS. 3A–3C: are perspective views of game elements with different lengths, which have to be used with the envelope according to the present invention.

The preferred embodiment of the present invention depicted in FIG. 1 comprises an envelope 1, being substantially cylindrical, in which apertures have been provided according to a regular pattern. The apertures 2 are mainly circular but each comprises two diametrically opposing extensions.

The envelope 1 surrounds the middle part of an inflated and closed balloon 3. A balloon with a longitudinal shape will be the most suitable.

In FIGS. 3A–3B game elements 4 are shown, which have to be used in the game to be played with the envelope 1. Each of the game elements 4 comprises a cylindrical part 5 and a concentric pin 6, extending therefrom. A cross bar 7 has been provided on the pin 6, on a certain distance from the cylindrical part 5. The distance between the cylindrical part 5 and the cross bar 7 is slightly larger than the thickness of the wall of the envelope 1. The length of the cross bar 7 is a slightly smaller than the greatest size of the apertures 2. Preferably, the game element 4 is made of plastic. In the drawing three game elements are shown, which have each a different length. Of course it is also possible to use another number of different lengths, for instance six.

The game which can be played with the envelope according to the present invention is played with at least two players. One of the players throws a die so that the die shows a number of dots. According to the rules of the game the player concerned has to insert a number of game elements through the apertures 2 of the envelope 1 and fix these therein, the number of game elements to be inserted being equal to the number of dots indicated by the die. As the shape of the apertures 2 in combination with the cross bars 7 of the game elements 4 constitute a bayonet catch, the fixing can be achieved easily by turning the game element after insertion. It is also possible to have the length of the element to be inserted determined by the die.

When the player has inserted the correct number of game elements the next player has to throw the die and this player also has to insert the number of game elements into the envelope 1, which number is determined by the die. This is proceeded until the balloon bursts. The player which has inserted the game element 4 into the envelope 1, which has caused the bursting of the balloon, is the loser.

The above lines only give an indication of the basic game rules. Of course these rules can be substantially varied, so that it is even possible with the envelope according to the present invention to play a gambling game.

When the envelope surrounds the inflatable element only partially the inserting of an element 1 into the envelope will decrease the volume for the contents of the balloon 3. This will make the volume 3 of the balloon outside the envelope increasing as well as the pressure prevailing within the balloon 3. With the increasing number of elements 4 inserted into the envelope 1 the raise of pressure within the balloon makes the tension on the walls of the balloon 3 increase until the limit is reached and the balloon burts.

In the cross-sectional view shown in FIG. 2 two game elements 4 have been inserted into the envelope 1 and have been fixed by turning those over a quarter turn. By inserting a game element into an aperture 2, which is adjacent to an aperture 2, in which a game element 4 has already been inserted, the volume of the balloon within the envelope 1 will be less decreased, than when the game element is inserted into an aperture 2, which is not adjacent to an aperture, in which a game element 4 has already been inserted. The length of the game element is also important in this matter.

To delay the bursting of the balloon the shape of the game elements can be adapted; for instance the pin 6 of the game element 4 can be provided with a rounded end.

Another advantage of the game which can be played with the envelope according to the present invention, is that a hammer is not anymore necessary. This makes the game suited for little children.

Also the game can be amended in several ways; instead of a die a spinner can be used.

When the envelope is made of translucent material it is perceptible to which degree the inflatable element has been pressed in by the game elements. This makes it possible to estimate the chances for bursting the balloon during the insertion of the next element, which enhances the suspense during the game.

Instead of dimensioning the envelope so that this clamps the balloon, it is also possible to provide ribs in the envelope clamping the balloon.

I claim:

1. A game construction which comprises the combination of a substantially rigid confining member defining a cavity accessible from one side of the confining member, a resilient, puncturable inflated member captive within the cavity, a plurality of elongate rods each of a length to penetrate partially into the cavity through the confining member into deforming engagement with the inflated member, and locking means for locking each rod in cavity penetrating, deforming position, the confining member being of substantially cylindrical form and the inflated member protruding from opposite ends thereof.

2. A game construction as defined in claim 1 wherein the confining member is provided with a plurality of openings distributed throughout the area thereof, each of a diameter to receive a rod, each rod having a smaller diameter, penetrating end and an enlarged opposite end which limits the penetration of the smaller diameter end into the cavity, and a bayonet pin lock on each smaller diameter end.

3. A game construction as defined in claim 2 wherein the confining member is defined by a circumferential wall of substantially uniform thickness, each bayonet pin lock being spaced from the enlarged end of its rod by an amount substantially equal to the wall thickness of the confining member.

4. A game construction comprising the combination of envelope means for defining a confining space, the envelope means including a peripheral wall having a plurality of apertures distributed therein, and a plurality of game element means for individual insertion through the apertures, each game element means being of a length to penetrate only partially into the confining space through an aperture selected by a game participant and including locking means for locking the inserted game element means in its pentrated position, and a single resilient inflated rupturable member confined in fixed position within the confining space with each of said apertures disposed in alignment with said rupturable member so that a game element means inserted through any aperture can contact and deform said rupturable member, whereby a plurality of game element means are adapted to simultaneously deform said rupturable member until it is ultimately squeezed into condition in which the insertion of a further game element means will effect its rupture.

5. A game construction comprising the combination of a single resilient, thin-walled rupturable inflated member of balloon-like form, envelope means for enclosing a portion only of the member so that the member may expand in size to stretch its thin wall throughout and expand it outside the confines of the envelope means as the member is squeezed by deformation, said rupturable member being confined in fixed position within said confining space and including a portion extending outside the confines of the envelope means at all times until it is ruptured, the envelope means having a plurality of apertures therein of similar size, and a plurality of game element means for individual insertion through the apertures at the choice of a game participant, each of said apertures being disposed in alignment with said inflatable member so that a game element means inserted through any aperture can contact and deform said rupturable member, each game element means having a potentially rupturing tip and being of a length to penetrate such tip only partially into the envelope means when inserted by a game participant and including locking means for locking each inserted game element means in its penetrated position so that the rupturable member is deformed and squeezed as the game element means are sequentially inserted and locked in place whereby the member is ultimately deformed and squeezed into condition in which the insertion of a further game element means will effect its rupture.

6. A game construction comprising the combination of envelope means for defining a confining space, the envelope means including a peripheral wall having a plurality of apertures distributed therein, and a plurality of game element means for individual insertion through the apertures, each game element means being of a length to penetrate only partially into the confining space through an aperture selected by a game participant and including locking means for locking the inserted game element means in its penetrated position so that a resilient, inflated rupturable member within the confining space is ultimately squeezed into condition in which the insertion of a further game element means will effect its rupture, said game element means being of different lengths to penetrate to different degrees partially into the confining space.

7. A game construction as defined in claim 6 wherein the envelope means is substantially cylindrical.

8. A game construction comprising the combination of envelope means for defining a confining space, the envelope means including a peripheral wall having a plurality of apertures distributed therein, and a plurality of game element means for individual insertion through the apertures, each game element means being of a length to penetrate only partially into the confining space through an aperture selected by a game participant and including locking means for locking the inserted game element means in its penetrated position so that a resilient, inflated rupturable member within the confining space is ultimately squeezed into condition in which the insertion of a further game element means will effect its rupture, said envelope means being substantially cylindrical.

9. A game construction comprising the combination of envelope means for defining a confining space, the envelope means including a peripheral wall having a plurality of apertures distributed therein, and a plurality of game element means for individual insertion through the apertures, each game element means being of a length to penetrate only partially into the confining space through an aperture selected by a game participant and including locking means for locking the inserted game element means in its penetrated position so that a resilient, inflated rupturable member within the confining space is ultimately squeezed into condition in which the insertion of a further game element means will effect its rupture, said envelope means being translucent.

10. A game construction comprising the combination of envelope means for defining a confining space, the envelope means including a peripheral wall having a plurality of apertures distributed therein, and a plurality of game element means for individual insertion through the apertures, each game element means being of a length to penetrate only partially into the confining space through an aperture selected by a game participant and including locking means for locking the inserted game element means in its penetrated position so that a resilient, inflated rupturable member within the confining space is ultimately squeezed into condition in which the insertion of a further game element means will effect its rupture, a resilient, inflated rupturable member confined by the envelope means, said envelope means being substantially cylindrical and the rupturable member protruding through the opposite ends thereof.

11. A game construction comprising the combination of a resilient, thin-walled inflated member of balloon-like form, envelope means for enclosing a portion only of the member so that the member may expand in size to stretch its thin wall throughout and expand it outside the confines of the envelope means as the member is squeezed by deformation, the envelope means having a plurality of apertures therein of similar size, and a plurality of game element means for individual insertion through the apertures at the choice of a game participant, each game element means having a potentially rupturing tip and being of a length to penetrate such tip only partially into the envelope means when inserted by a game participant and including locking means for locking each inserted game element means in its penetrated position so that the rupturable member is deformed and squeezed as the game element means are sequentially inserted and locked in place whereby the member is ultimately deformed and squeezed into condition in which the insertion of a further game element means will effect its rupture, said game element means being of different lengths to penetrate to different degrees partially into the envelope means.

12. A game construction as defined in claim 11 wherein the envelope means is substantially cylindrical.

13. A game construction comprising the combination of a resilient, thin-walled inflated member of balloon-like form, envelope means for enclosing a portion only of the member so that the member may expand in size to stretch its thin wall throughout and expand it outside the confines of the envelope means as the member is squeezed by deformation, the envelope means having a plurality of apertures therein of similar size, and a plurality of game element means for individual insertion through the apertures at the choice of a game participant, each game element means having a potentially rupturing tip and being of a length to penetrate such tip only partially into the envelope means when inserted by a game participant and including locking means for locking each inserted game element means in its penetrated position so that the rupturable member is deformed and squeezed as the game element means are sequentially inserted and locked in place whereby the member is ultimately deformed and squeezed into condition in which the insertion of a further game element means will effect its rupture, said envelope means being substantially cylindrical.

14. A game construction comprising the combination of a resilient, thin-walled inflated member of balloon-like form, envelope means for enclosing a portion only of the member so that the member may expand in size to stretch its thin wall throughout and expand it outside the confines of the envelope means as the member is squeezed by deformation, the envelope means having a plurality of apertures therein of similar size, and a plurality of game element means for individual insertion through the apertures at the choice of a game participant, each game element means having a potentially rupturing tip and being of a length to penetrate such tip only partially into the envelope means when inserted by a game participant and including locking means for locking each inserted game element means in its penetrated position so that the rupturable member is deformed and squeezed as the game element means are sequentially inserted and locked in place whereby the member is ultimately deformed and squeezed into condition in which the insertion of a further game element means will effect its rupture, said envelope means being translucent.

15. A game construction comprising the combination of a resilient, thin-walled inflated member of balloon-like form, envelope means for enclosing a portion only of the member so that the member may expand in size to stretch its thin wall throughout and expand it outside the confines of the envelope means as the member is squeezed by deformation, the envelope means having a plurality of apertures therein of similar size, and a plurality of game element means for individual insertion through the apertures at the choice of a game participant, each game element means having a potentially rupturing tip and being of a length to penetrate such tip only partially into the envelope means when inserted by a game participant and including locking means for locking each inserted game element means in its penetrated position so that the rupturable member is deformed and squeezed as the game element means are sequentially inserted and locked in place whereby the member is ultimately deformed and squeezed into condition in which the insertion of a further game element means will effect its rupture, said envelope means being substantially cylindrical and the rupturable member protruding through the opposite ends thereof.

* * * * *